US010512284B2

(12) United States Patent
Wang et al.

(10) Patent No.: US 10,512,284 B2
(45) Date of Patent: Dec. 24, 2019

(54) ATOMIZER OF ELECTRONIC CIGARETTE

(71) Applicant: O-NET AUTOMATION TECHNOLOGY (SHENZHEN) LIMITED, Shenzhen, Guangdong (CN)

(72) Inventors: Feng Wang, Guangdong (CN); Cheng Wang, Guangdong (CN); Fei Shen, Guangdong (CN)

(73) Assignee: O-NET AUTOMATION TECHNOLOGY (SHENZHEN) LIMITED, Shenzhen (CN)

( * ) Notice: Subject to any disclaimer, the term of this patent is extended or adjusted under 35 U.S.C. 154(b) by 412 days.

(21) Appl. No.: 15/347,739

(22) Filed: Nov. 9, 2016

(65) Prior Publication Data

US 2017/0049156 A1 Feb. 23, 2017

Related U.S. Application Data

(63) Continuation of application No. PCT/CN2015/072438, filed on Feb. 6, 2015.

(51) Int. Cl.

| | |
|---|---|
| ***A24F 47/00*** | (2006.01) |
| ***H05B 3/03*** | (2006.01) |
| ***H05B 3/44*** | (2006.01) |
| ***H05B 3/46*** | (2006.01) |

(52) U.S. Cl.

CPC ..... *A24F 47/008* (2013.01); *H05B 3/03* (2013.01); *H05B 3/44* (2013.01); *H05B 3/46* (2013.01); *H05B 2203/014* (2013.01); *H05B 2203/021* (2013.01)

(58) Field of Classification Search

CPC ..... A24F 47/008; H05B 3/46; H05B 3/03; H05B 3/44; H05B 2203/021; H05B 2203/014

USPC ..... 392/397, 404, 490, 494, 534; 131/328, 131/329; 219/482, 490, 494, 534, 329

See application file for complete search history.

(56) References Cited

U.S. PATENT DOCUMENTS

| | | | | |
|---|---|---|---|---|
| 8,997,753 | B2 * | 4/2015 | Li | H01C 17/00 131/273 |
| 9,578,898 | B2 * | 2/2017 | Liu | A24F 47/008 |
| 2011/0303231 | A1 * | 12/2011 | Li | A24F 47/008 131/329 |
| 2012/0204889 | A1 * | 8/2012 | Xiu | A24F 47/008 131/273 |
| 2013/0180533 | A1 * | 7/2013 | Kim | A24F 47/008 131/273 |
| 2013/0276798 | A1 * | 10/2013 | Hon | A24F 47/008 131/273 |
| 2013/0319436 | A1 * | 12/2013 | Liu | A24F 47/008 131/329 |

(Continued)

*Primary Examiner* — Michael G Hoang
*Assistant Examiner* — Tiffany T Tran

(57) ABSTRACT

An atomizer of an electronic cigarette includes an atomizing assembly, a smoke tube and a cigarette holder. The atomizing assembly includes: a heating module including a ceramic base and a heating wire winding around the ceramic base; and a snap base including an upper snap base and a lower snap base. The heating module is longitudinally provided between the upper snap base and the lower snap base. The upper snap base includes a first air channel in communication with a smoke channel and a liquid channel in communication with a liquid storage cavity. The lower snap base includes a second air channel in communication with the first air channel.

19 Claims, 5 Drawing Sheets

(56) References Cited

U.S. PATENT DOCUMENTS

2014/0216485 A1* 8/2014 Egoyants ..... A24F 47/008 131/329
2014/0261408 A1* 9/2014 DePiano ..... A24F 47/008 128/202.21
2014/0261489 A1* 9/2014 Cadieux ..... A24F 47/008 131/328
2014/0261500 A1* 9/2014 Park ..... A24F 47/008 131/329
2014/0360514 A1* 12/2014 Zhu ..... A24F 47/008 131/329
2014/0360516 A1* 12/2014 Liu ..... A61M 15/06 131/329
2015/0040929 A1* 2/2015 Hon ..... A24F 47/008 131/329
2015/0128970 A1* 5/2015 Liu ..... A24F 47/008 131/329
2015/0181940 A1* 7/2015 Liu ..... A24D 3/043 131/329
2015/0181943 A1* 7/2015 Li ..... H05B 3/48 131/329
2015/0223522 A1* 8/2015 Ampolini ..... A24F 47/008 131/328
2015/0296887 A1* 10/2015 Zhu ..... A24F 47/008 131/329
2015/0335070 A1* 11/2015 Sears ..... H05B 1/0288 131/328
2016/0000145 A1* 1/2016 Liu ..... A61M 15/06 131/329
2016/0000146 A1* 1/2016 Zhu ..... A24F 47/008 392/404
2016/0007653 A1* 1/2016 Tu ..... A24F 47/008 392/403
2016/0106153 A1* 4/2016 Zhu ..... A24F 47/008 131/329
2016/0106155 A1* 4/2016 Reevell ..... A24F 47/008 131/329
2016/0157522 A1* 6/2016 Zhu ..... A24F 47/008 131/329
2016/0183597 A1* 6/2016 Li ..... H05B 1/0244 392/404
2016/0249682 A1* 9/2016 Leadley ..... A24F 47/008 131/329

* cited by examiner

ATOMIZER OF ELECTRONIC CIGARETTE

CROSS-REFERENCE TO RELATED APPLICATIONS

The present application is a Continuation Application of PCT application No. PCT/CN2015/072438 filed on Feb. 6, 2015, the contents of which are hereby incorporated by reference.

TECHNICAL FIELD

The present invention relates to the technical field of electronic cigarettes, and in particular to an atomizer of electronic cigarette.

BACKGROUND

An electronic cigarette, also called an e-cigarette, is mainly used for smoking cessation and used as an alternative to cigarettes. The electronic cigarette is similar to a cigarette in appearance and smell, but generally contains no tar, suspended particulates and other harmful components as contained in the cigarette, thereby producing no pervasive or swirling second-hand smoke The electronic cigarette mainly consists of an atomizer and a power supply assembly. The atomizer generally comprises a liquid storing cavity, a heating wire, a heating wire support body (a liquid absorbing rope), positive and negative atomizer electrodes and the like. In a common electronic cigarette, the heating wire is winding around the heating wire support body to form a heating element. Wherein, two ends of the heating wire are electrically connected with the positive and negative atomizer electrodes via through holes in a cartridge to implement heating operation.

However, the connecting manner of the heating element leads to instability in energization. Particularly, it is troublesome to the mount the heating wire and the positive and negative atomizer electrodes, and the atomizer of electronic cigarette is complicate in structure and inconvenient for fully-automatic production of the atomizer of electronic cigarette.

SUMMARY

A technical problem to be solved by the present invention is to provide an atomizer of electronic cigarette, which is strong in stability, simple in structure and convenient for automatic production, with respect to the defects as described above in the prior art.

A technical solution employed by the present invention to solve the technical problem thereof is to provide an atomizer of electronic cigarette, comprising an atomizing assembly, a smoke duct and a cigarette holder, the smoke duct comprising a liquid storing cavity for storing tobacco liquid and a smoke flue, and being in a fitted mounting respectively with the atomizing assembly and the cigarette holder, and the atomizing assembly comprising:

a heating module, comprising a ceramic base and a heating wire winding around the ceramic base, the ceramic base being of a hollow micropore structure and communicated with the liquid storing cavity; and a cartridge, comprising an upper cartridge and a lower cartridge, the heating module being longitudinally disposed between the upper cartridge and the lower cartridge, the upper cartridge comprising a first air channel communicated with the smoke flue and a liquid channel communicated with the liquid storing cavity, and the lower cartridge comprising a second air channel communicated with the first air channel, wherein the heating wire is electrically connected with the upper cartridge and the lower cartridge respectively, and the hollow micropore structure of the ceramic base is communicated with the liquid storing cavity through the liquid channel.

In an embodiment, the atomizing assembly further comprises an atomizing core casing in a fitted mounting with the upper and lower cartridges respectively, the atomizing core casing comprising an air cavity which is communicated with the first air channel and the second air channel respectively.

In an embodiment, the upper cartridge is electrically connected with the atomizing core casing.

In an embodiment, the upper cartridge also comprises a first accommodating groove for accommodating the heating module; the first accommodating groove is provided with a channel port of the liquid channel at a groove bottom; and the hollow micropore structure of the ceramic base is communicated with the liquid channel through the channel port.

In an embodiment, the atomizing assembly also comprises an insulating ring fitted with the lower cartridge, and the insulating ring is disposed between the lower cartridge and the atomizing core casing.

In an embodiment, the atomizing assembly also comprises an outer electrode mode electrically connected with the lower cartridge.

In an embodiment, the atomizing assembly also comprises a seal gasket, which is disposed between the lower cartridge and the heating module.

In an embodiment, the upper cartridge and the lower cartridge are provided with opposite electrodes.

In an embodiment, the heating module also comprises connecting terminals disposed at two ends of the ceramic base; the heating wire is connected with the connecting terminals and is electrically connected with the upper cartridge and the lower cartridge through the connecting terminals respectively.

In an embodiment, the connecting terminals comprise terminal through holes fitted with the hollow micropore structure of the ceramic base.

The present invention has the advantageous effects that compared with the prior art, with the design of the upper and lower conductive cartridges according to the present invention, the heating module is longitudinally disposed between the upper cartridge and the lower cartridge and is electrically connected with the upper cartridge and the lower cartridge respectively, thereby simplifying the structure and increasing the stability for the atomizer of electronic cigarette; and the atomizer of electronic cigarette is simple in structure and convenient to mount, thereby facilitating fully-automatic production and increasing production efficiency.

BRIEF DESCRIPTION OF DRAWINGS

The present invention will be further described below with reference to the attached drawings and the embodiments, in which.

DETAILED DESCRIPTION

Preferred embodiments of the present invention will now be described in details with reference to the attached drawings.

Figure 1:
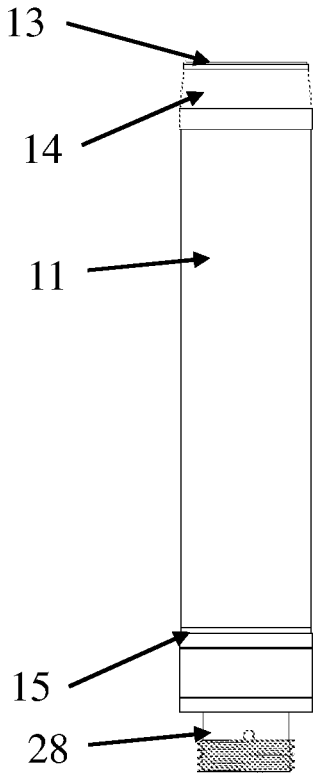
FIG. 1 is a structural schematic diagram of an atomizer of electronic cigarette of the present invention.
Figure 2:
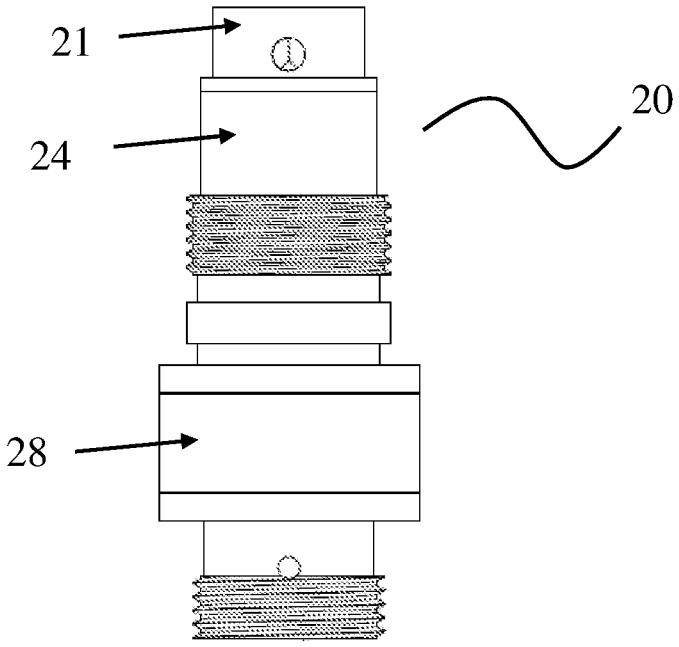
FIG. 2 is a structural schematic diagram of an atomizing assembly of the present invention.
Figure 3:
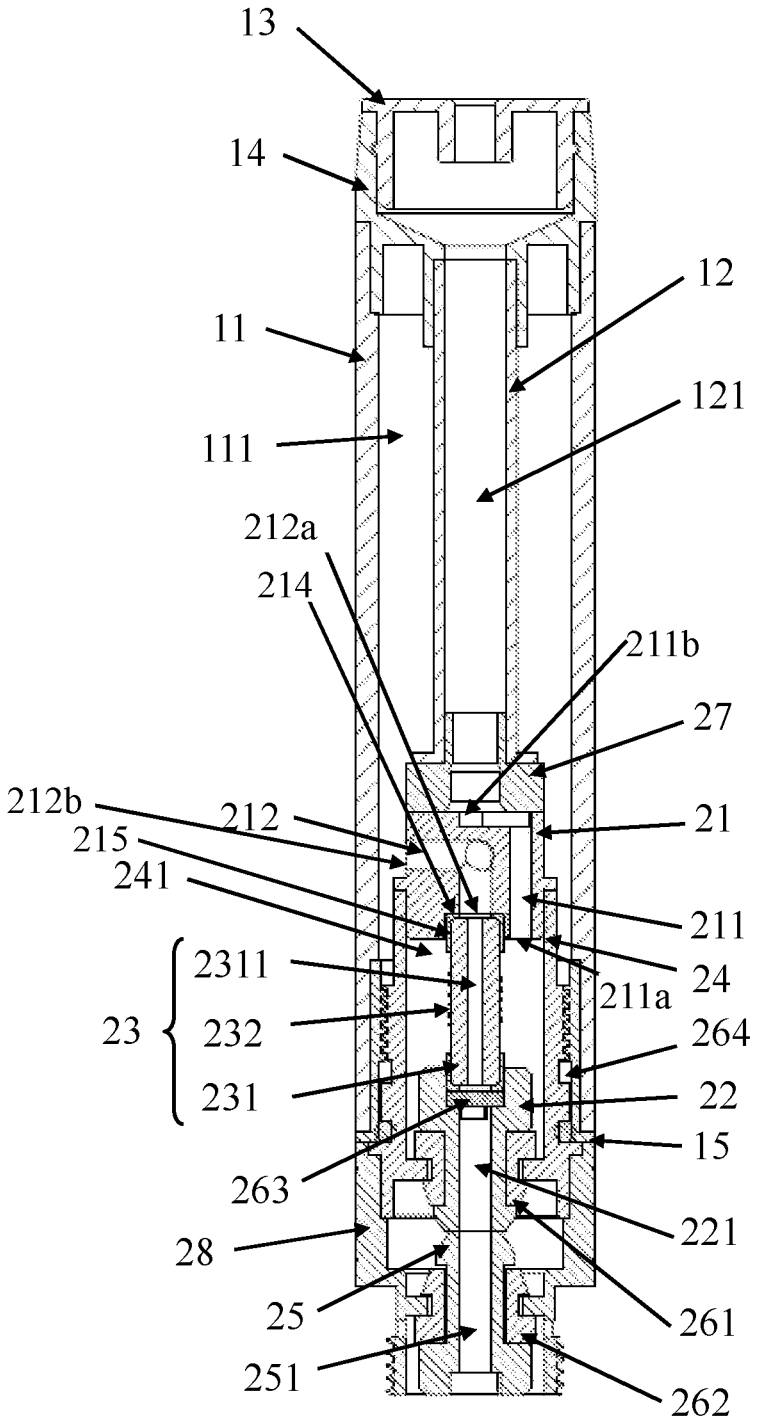
FIG. 3 is a cross-section schematic diagram of the atomizer of electronic cigarette of the present invention.
Figure 4:
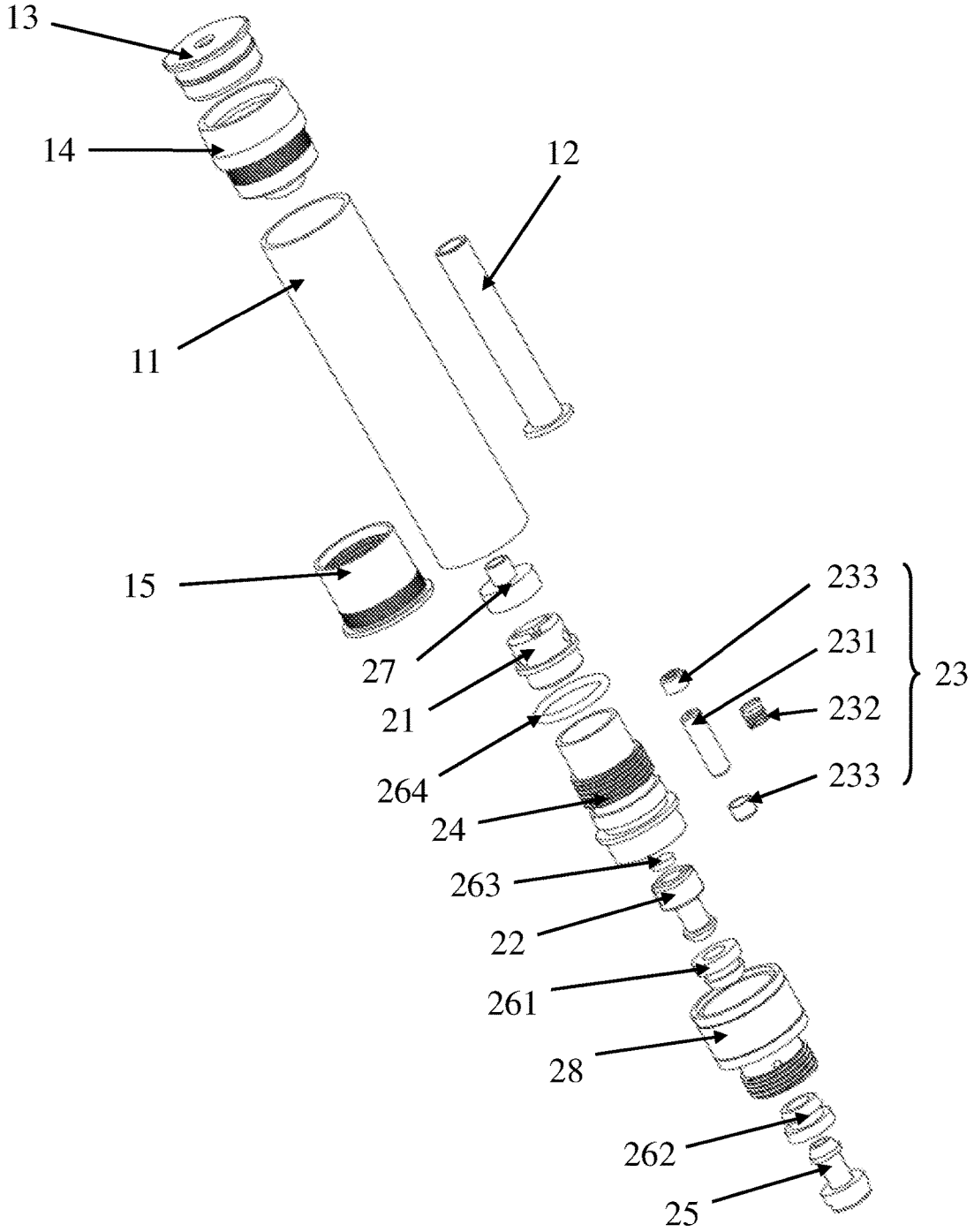
FIG. 4 is a schematic diagram of an exploded structure of the atomizer of electronic cigarette of the present invention.

As shown in FIGS. 1 to 4, the present invention provides a preferred embodiment of an atomizer of electronic cigarette to improve the stability of the atomizer of electronic cigarette and facilitate fully-automatic production, with FIG. 1 being a structural schematic diagram of the atomizer of electronic cigarette, FIG. 2 being a structural schematic diagram of an atomizing assembly, FIG. 3 being a cross-section schematic diagram of the atomizer of electronic cigarette, and FIG. 4 being a schematic diagram of an exploded structure of the atomizer of electronic cigarette.

An atomizer of electronic cigarette comprises an atomizing assembly 20, a smoke duct 11 and a cigarette holder 13. The smoke duct 11 comprises a liquid storing cavity 21 for storing tobacco liquid and a smoke flue 121, and is in a fitted mounting respectively with the atomizing assembly 20 and the cigarette holder 13. The atomizing assembly 20 comprises a heating module 23 and a cartridge. The heating module 23 comprises a ceramic base 231 and a heating wire 232 winding around the ceramic base 231. The ceramic base 231 is of a hollow micropore structure 2311 and communicated with the liquid storing cavity 111. The cartridge comprises an upper cartridge 21 and a lower cartridge 22. The heating module 23 is longitudinally disposed between the upper cartridge 21 and the lower cartridge 22. The upper cartridge 21 comprises a first air channel 211 communicated with the smoke flue 121 and a liquid channel 212 communicated with the liquid storing cavity 111. The lower cartridge 22 comprises a second air channel 221 communicated with the first air channel 211.

In an embodiment, the heating wire 232 is electrically connected with the upper cartridge 21 and the lower cartridge 22 respectively. The hollow micropore structure 2311 of the ceramic base 231 is communicated with the liquid storing cavity 111 through the liquid channel 212. When smoking through the cigarette holder 13, air in the ceramic base 231 is driven and the tobacco liquid is made to flow into the hollow micropore structure 2311 of the ceramic base 231; and under this state after the heating wire 232 is energized to heat, the tobacco liquid is heated and atomized into smoke, which penetrates through the ceramic base 231 and flows into the air channel to pass through the smoke flue 121 along with the air and flow out at the cigarette holder 13.

In an embodiment, the smoke duct 11 internally comprises a smoke flue duct 12 provided with the smoke flue 12, which is preferably disposed in the center of the smoke duct 11. An inner side wall of the smoke duct 11 and an outer side wall of the smoke flue duct 12 form the liquid storing cavity 111. Specifically, the inner side wall of the smoke duct 11, the outer side wall of the smoke flue duct 12, an inner side face of the cigarette holder 13 and the atomizing assembly 20 form the liquid storing cavity 111.

In an embodiment, the cigarette holder 13 comprises a cigarette holder port communicated with the smoke flue 121; and a liquid storing cavity top cover 14 is disposed between the cigarette holder 13 and the smoke duct 11 for sealing the liquid storing cavity 111 to improve the tightness of the liquid storing cavity 111.

In the present embodiment, to facilitate the mounting of the upper cartridge 21 and the lower cartridge 22 and the heating and atomizing of the tobacco liquid into smoke by the heating module 23. The atomizing assembly 20 further comprises an atomizing core casing 24 in a fitted mounting respectively with the upper cartridge 21 and the lower cartridge 22. The atomizing core casing 24 comprises an air cavity 241, which is formed by surrounding of the atomizing core casing 24, the upper cartridge 21, the lower cartridge 22 and the ceramic base 231. In an embodiment, the heating wire 232 is disposed in the air cavity 241, and the air cavity 241 is communicated with the first air channel 211 and the second air channel 221 respectively. An O-shaped seal ring 264 is disposed between the atomizing core casing 24 and the smoke duct 11, and a side face of the atomizing core casing 24 is provided with a groove for holding the O-shaped seal ring 264, which is used for preventing the tobacco liquid in the liquid storing cavity 111 from flowing out.

To facilitate the connection between the atomizing core casing 24 and the smoke duct 11, the atomizing core casing 24 is connected to the bottom of the smoke duct 11 through a threaded structure. Or, a liquid storing cavity base 15 is disposed between the atomizing core casing 24 and the smoke duct 11. The atomizing core casing 24 is connected to the liquid storing cavity base 15 through the threaded structure, and connected with the bottom of the smoke duct 11 through the liquid storing cavity base 15. Meanwhile, the liquid storing cavity base 15 prevents the tobacco liquid in the liquid storing cavity 111 from flowing out.

The present embodiment comprises an air passage and a liquid passage, and the heating module 23 heats and atomizes the tobacco liquid in the liquid passage into smoke to enter the air channel. In an embodiment, the air passage comprises the cigarette holder 13 port, the smoke flue 121, the first air channel 211, the air cavity 241 and the second air channel 221 from top to bottom The liquid passage comprises the liquid storing cavity 111, the liquid channel 212 and the hollow micropore structure 2311 from top to bottom.

In an embodiment, the upper cartridge 21 and the lower cartridge 22 are provided with opposite electrodes. For example, the upper cartridge 21 is provided with a positive electrode. The lower cartridge 22 is provided with a negative electrode and is electrically connected with the heating wire 232, the upper cartridge 21. The heating wire 232 and the lower cartridge 22 form a current circuit, and the heating 232 heats after being energized.

Figure 5:
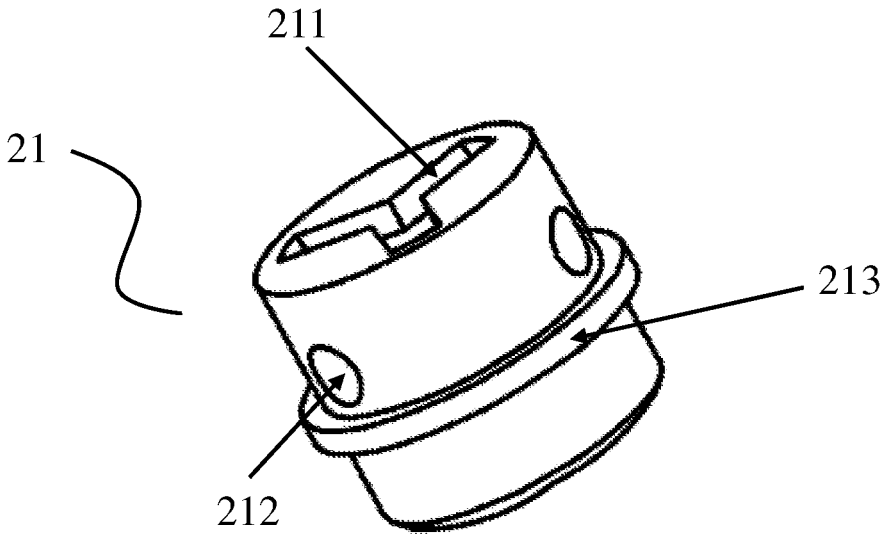
FIG. 5 is a structural schematic diagram of an upper cartridge of the present invention.
Figure 6:
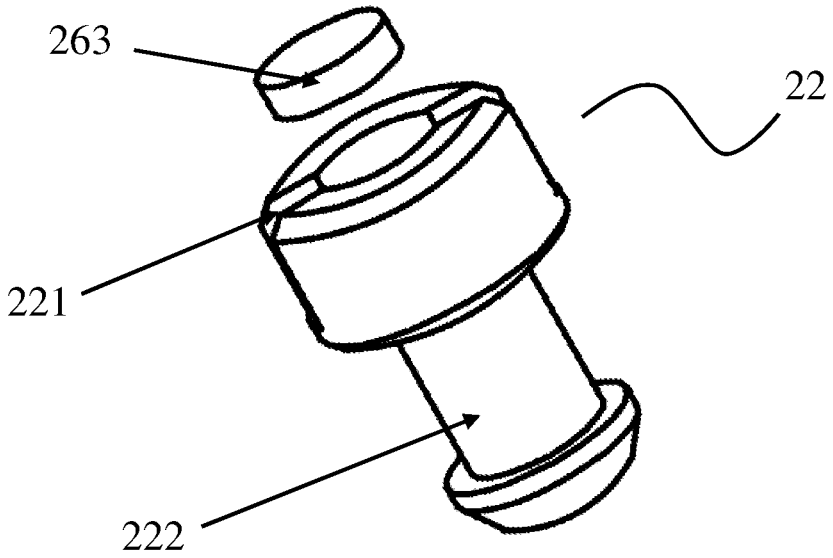
FIG. 6 is a structural schematic diagram of a lower cartridge of the present invention.

Further, with reference to FIGS. 4 to 6, the present invention provides preferred embodiments of the upper and lower cartridges, with FIG. 5 being a structural schematic diagram of the upper cartridge, and FIG. 6 being a structural schematic diagram of the lower cartridge.

The upper cartridge 21 is disposed at the top of the atomizing core casing 24 and connected with the smoke flue duct 12, and comprises a first accommodating groove, a first air channel 211 and a liquid channel 212.

Specifically, the upper cartridge 21 is electrically connected with the atomizing core casing 24, and the atomizing core casing 24 is connected with an electrode of a power supply and supplies an electrode voltage to the upper cartridge 21. The upper cartridge 21 comprises a first accommodating groove 214 at the bottom for accommodating a heating module 23. The first accommodating groove 214 is provided with a channel port 212*a* of the liquid channel 212 at a groove bottom. The hollow micropore structure 2311 of the ceramic base 231 is communicated with the liquid channel 212 through the channel port 212*a*. The first accommodating groove 214 is used for fixing the ceramic base 231, and to prevent the tobacco liquid from flowing out. A sealant 215 can be disposed between the first accommodating groove 214 and the ceramic base 231. A channel port 212*b* at the other end of the liquid channel 212 of the upper cartridge 21 is disposed on a side face of the upper cartridge 21, and is communicated with the liquid storing cavity 111. A vent port 211*a* at one end of the first air channel 211 of the upper cartridge 21 is disposed at the bottom face of the upper cartridge 21 and communicated with the air cavity 241. A vent port 211*b* at the other end of the same is disposed right in the center of the top of the upper cartridge 21 and is communicated with the smoke flue 121. The upper cartridge 21 is provided with a limiting member 213 on a side face for fixing the upper cartridge 21 on the top of the atomizing core casing 24.

In an embodiment, a seal ring 27 is also disposed between the upper cartridge 21 and the smoke flue duct 12 to prevent the smoke from flowing out in the smoke circulation in the first air channel 211 and the smoke flue 121.

A first insulting ring 261 is disposed between the lower cartridge 22 and the atomizing core casing 24. The lower cartridge 22 is fixed at the bottom of the atomizing core casing 24 through the first insulating ring 261, and comprises a second accommodating groove and a second air channel 221.

Specifically, the lower cartridge 22 comprises a second accommodating groove at the top for accommodating the heating module 23. The second accommodating groove is a sealing groove to prevent the tobacco liquid in the hollow micropore structure 2311 of the ceramic base 231 from flowing out. To further prevent the tobacco liquid from flowing out, a seal gasket 263 can be disposed between the second accommodating groove and the ceramic base 231. The vent port at one end of the second air channel 221 of the lower cartridge 22 is disposed at the bottom face of the lower cartridge and is communicated with the outside. A vent port at the other end of the same is disposed at the top or side face of the lower cartridge 22 and is communicated with the air cavity 241. The lower cartridge 22 is provided with a groove ring at the side face for holding the first insulating ring 261.

In an embodiment, the atomizing assembly 20 also comprises an outer electrode module 25 electrically connected with the lower cartridge 22. The outer electrode module 25 is connected with the electrode of the power supply and supplies the electrode voltage to the lower cartridge 22. The outer electrode module 25 comprises a third air channel 251 communicated with the second air channel 221; and the third air channel 251 is communicated with the outside.

The outer electrode module 25 is connected with the atomizing core casing 24 through an atomizing core base 28. The atomizing core base 28 is connected with the outer electrode module 25 and the atomizing core casing 24 respectively. The atomizing core casing 24 is provided with a threaded structure connected with an outer apparatus, on a side face.

To prevent the outer electrode module 25 from contact short-circuiting, a second insulating ring 262 is disposed between the outer electrode module 25 and the atomizing core base 28. Preferably, to facilitate production, the lower cartridge 22 and the outer electrode module 25 may be the same apparatus. To guarantee the tightness between the hollow micropore structure 2311 of the ceramic base 231 and the lower cartridge 22, the seal gasket 263 can be used for sealing; and the lower cartridge 22 is provided with a groove for holding the seal gasket 263.

Figure 7:
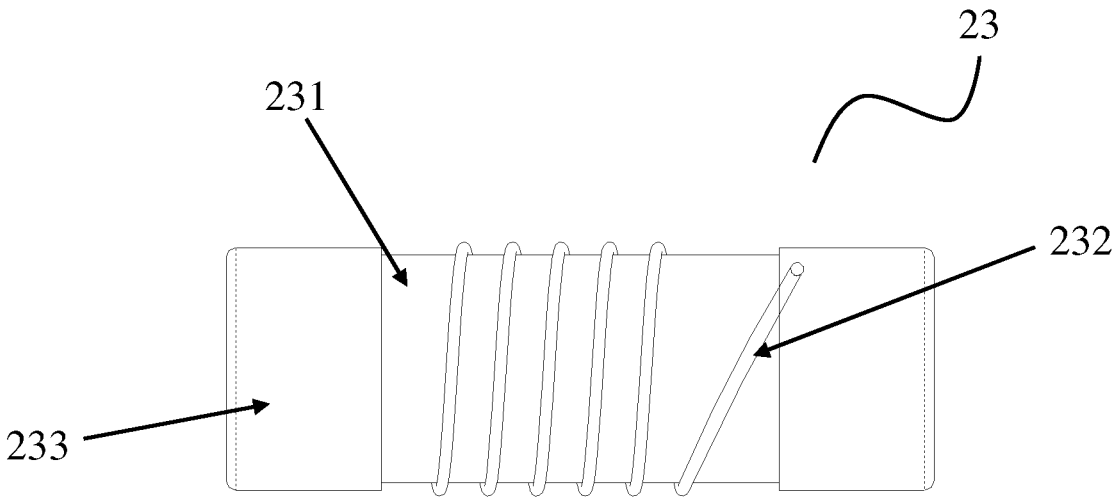
FIG. 7 is a structural schematic diagram of a heating module of the present invention.

Further, with reference to FIGS. 4 and 7, preferred embodiments of the heating module are provided, with FIG. 4 being a schematic diagram of an exploded structure of the atomizer of electronic cigarette, and FIG. 7 being a structural schematic diagram of the heating module.

The heating module 23 further comprises connecting terminals 233 disposed on two ends of the ceramic base 231. The connecting terminals 233 comprise a first connecting terminal and a second connecting terminal, which are disposed at two sides; and the ceramic base 231 is abutted against the first accommodating groove of the upper cartridge 21 and the second accommodating groove of the lower cartridge 22 through the connecting terminals 233 respectively. The connecting terminals 233 are conductors; and the heating wire 232 is connected with the connecting terminals 233 and is electrically connected with the upper cartridge 21 and the lower cartridge 22 through the connecting terminals 233 respectively.

In an embodiment, the connecting terminals 233 comprise terminal through holes fitted with the hollow micropore structure 2311 of the ceramic base 231. The hollow micropore structure 2311 of the ceramic base 231 is communicated with the liquid channel 212 through the connecting terminals 233.

The description above shall not be construed as limiting the scope of the present invention but as merely providing preferred embodiments of the present invention. Any equivalent variations or modifications made based on the patent scope of the present invention application shall be encompassed by the present invention.

What is claimed is:

1. An atomizer of electronic cigarette, comprising:

an atomizing assembly, a smoke duct, and a cigarette holder, wherein the smoke duct comprises a liquid storing cavity for storing tobacco liquid and a smoke flue, the smoke duct is in a fitted mounting respectively with the atomizing assembly and the cigarette holder, wherein the atomizing assembly comprises:

a heating module, comprising a ceramic base and a heating wire winding around the ceramic base, the ceramic base being of a hollow micropore structure and communicated with the liquid storing cavity; and a cartridge, comprising an upper cartridge and a lower cartridge, the heating module being longitudinally disposed between the upper cartridge and the lower cartridge, the upper cartridge comprising a first air channel communicated with the smoke flue and a liquid channel communicated with the liquid storing cavity, and the lower cartridge comprising a second air channel communicated with the first air channel, and wherein the heating wire is electrically connected with the upper cartridge and the lower cartridge respectively, and the hollow micropore structure of the ceramic base is communicated with the liquid storing cavity through the liquid channel;

wherein the atomizing assembly further comprises an atomizing core casing in a fitted mounting with the upper and lower cartridges respectively, the atomizing core casing comprising an air cavity which is communicated with the first air channel and the second air channel respectively;

wherein the upper cartridge is disposed at a top of the atomizing core casing and further comprises a first accommodating groove for accommodating the heating module; the first accommodating groove is used for fixing the ceramic base, and a sealant is disposed between the first accommodating groove and the ceramic base;

wherein the first accommodating groove is provided with a channel port at an end of the liquid channel at a groove bottom; and the hollow micropore structure of the ceramic base is communicated with the liquid channel through the channel port at the end of the liquid channel; a channel port at an other end of the liquid channel is disposed on a side face of the upper cartridge, and is communicated with the liquid storing cavity;

wherein a vent port at one end of the first air channel is disposed at a bottom face of the upper cartridge and communicated with the air cavity; a vent port at an other end of the first air channel is disposed in a center of a top of the upper cartridge and is communicated with the smoke flue.

2. The atomizer of electronic cigarette according to claim 1, wherein the upper cartridge is electrically connected with the atomizing core casing.

3. The atomizer of electronic cigarette according to claim 1, wherein the atomizing assembly further comprises a first insulating ring fitted with the lower cartridge, and the first insulating ring is disposed between the lower cartridge and the atomizing core casing.

4. The atomizer of electronic cigarette according to claim 3, wherein the atomizing assembly further comprises an outer electrode module electrically connected with the lower cartridge.

5. The atomizer of electronic cigarette according to claim 4, wherein the atomizing assembly further comprises a seal gasket, which is disposed between the lower cartridge and the heating module.

6. The atomizer of electronic cigarette according to claim 1, wherein the upper cartridge and the lower cartridge are provided with opposite electrodes.

7. The atomizer of electronic cigarette according to claim 1, wherein the heating module further comprises connecting terminals disposed at two ends of the ceramic base, the ceramic base is abutted against the first accommodating groove of the upper cartridge and a second accommodating groove of the lower cartridge through the connecting terminals respectively; and the heating wire is electrically connected with the connecting terminals and is electrically connected with the upper cartridge and the lower cartridge through the connecting terminals respectively.

8. The atomizer of electronic cigarette according to claim 7, wherein the connecting terminals comprise terminal through holes fitted with the hollow micropore structure of the ceramic base.

9. The atomizer of electronic cigarette according to claim 1, wherein the upper cartridge is provided with a limiting member on a side face for fixing the upper cartridge on the top of the atomizing core casing.

10. The atomizer of electronic cigarette according to claim 1, wherein the smoke duct internally comprises a smoke flue duct provided with the smoke flue, which is disposed in a center of the smoke duct; an inner side wall of the smoke duct, an outer side wall of the smoke flue duct, an inner side face of the cigarette holder and the atomizing assembly form the liquid storing cavity.

11. The atomizer of electronic cigarette according to claim 1, wherein the cigarette holder comprises a cigarette holder port communicated with the smoke flue; and a liquid storing cavity top cover is disposed between the cigarette holder and the smoke duct for sealing the liquid storing cavity.

12. The atomizer of electronic cigarette according to claim 1, wherein the air cavity is formed by surrounding of the atomizing core casing, the upper cartridge, the lower cartridge and the ceramic base; and the heating wire is disposed in the air cavity.

13. The atomizer of electronic cigarette according to claim 1, wherein an O-shaped seal ring is disposed between the atomizing core casing and the smoke duct, and a side face of the atomizing core casing is provided with a groove for holding the O-shaped seal ring.

14. The atomizer of electronic cigarette according to claim 1, wherein a liquid storing cavity base is disposed between the atomizing core casing and the smoke duct; the atomizing core casing is connected to the liquid storing cavity base through a threaded structure, and connected with a bottom of the smoke duct through the liquid storing cavity base.

15. The atomizer of electronic cigarette according to claim 1, wherein a seal ring is disposed between the upper cartridge and the smoke flue duct.

16. The atomizer of electronic cigarette according to claim 3, wherein the lower cartridge is fixed at a bottom of the atomizing core casing through the first insulating ring; a vent port at one end of the second air channel is disposed at a bottom face of the lower cartridge and is communicated with an outside; and a vent port at an other end of the second air channel is disposed at a top or side face of the lower cartridge and is communicated with the air cavity; the lower cartridge is provided at a side face with a groove ring for holding the first insulating ring.

17. The atomizer of electronic cigarette according to claim 4, wherein the outer electrode module comprises a third air channel communicated with the second air channel; and the third air channel is communicated with an outside.

18. The atomizer of electronic cigarette according to claim 4, wherein the outer electrode module is connected with the atomizing core casing through an atomizing core base; the atomizing core base is connected with the outer electrode module and the atomizing core casing respectively; the atomizing core casing is provided on a side face with a threaded structure connected with an outer apparatus.

19. The atomizer of electronic cigarette according to claim 4, wherein a second insulating ring is disposed between the outer electrode module and the atomizing core base.

* * * * *